US005191659A

United States Patent [19]

Backus

[11] Patent Number: 5,191,659

[45] Date of Patent: Mar. 9, 1993

[54] ORTHOPEDIC ACCESS PANTS

[76] Inventor: Darlene F. Backus, 6445 Gillis Dr., Jackson, Mich. 49201

[21] Appl. No.: 824,386

[22] Filed: Jan. 23, 1992

[51] Int. Cl.[5] ..... A41D 1/06

[52] U.S. Cl. ..... 2/227; 2/228; 2/79; 2/75; 2/76; 2/80; 2/DIG. 7

[58] Field of Search ..... 2/227, 228, 79, 75, 2/76, 80, DIG. 7

[56] References Cited

U.S. PATENT DOCUMENTS

| | | | |
|---|---|---|---|
| 1,489,046 | 4/1924 | Thompson | 2/DIG. 7 |
| 2,520,026 | 8/1950 | Beitchman | 2/227 |
| 4,258,440 | 3/1981 | McGowan . | |
| 4,638,509 | 1/1987 | Charron | 2/227 |
| 4,644,589 | 2/1987 | Pettis | 2/DIG. 7 |
| 4,651,353 | 3/1987 | Walden . | |
| 4,737,995 | 4/1988 | Wiley | 2/DIG. 7 |
| 4,766,613 | 8/1988 | Wells | 2/227 |
| 4,914,756 | 4/1990 | Grassick | 2/227 |

OTHER PUBLICATIONS

Gershman, Maurice "Self Adhering Nylon Tapes", Journal of the American Medical Association, vol. 168, No. 7 p. 930, Oct. 18, 1958.

*Primary Examiner*—Andrew M. Falik
*Assistant Examiner*—Gloria Hale
*Attorney, Agent, or Firm*—Beaman & Beaman

[57] ABSTRACT

An orthopedic pant garment consisting of identical front and rear panels wherein the outer edges of at least one of the garment leg portions is releasably interconnected by fasteners, preferably of the hook and loop type. The fasteners are spaced from each other to provide medical apparatus access to the wearer's leg or hip and as the entire vertical length of a leg portion may be opened at its outer edge by releasing the fasteners, full access to the leg is possible while preserving the patient's modesty and dignity.

3 Claims, 1 Drawing Sheet

ORTHOPEDIC ACCESS PANTS

BACKGROUND OF THE INVENTION

1. Field of the Invention

The invention pertains to hospital and orthopedic patient pant garments capable of completely enclosing the patient's torso, front and rear, and wherein leg portions of the garment may be longitudinally partially or fully opened to provide access to the limb being treated.

2. Description of the Related Art

Hospital gowns and garments usually consist of a front panel or apron which entirely covers the patient's front, and the gown utilizes ties to wrap the edges of the gown around the patient's body. Usually, conventional hospital gowns do not adequately cover the rear of the patient's torso often creating embarrassment to the patient, and yet, such gowns may not provide the desired degree of access to the patient's legs, such as those orthopedic patients whose legs have been operated upon by surgery, or otherwise treated.

Garments have been proposed for patients and the handicapped wherein the garments consist of a plurality of interconnected panels whereby the patient's body may be enclosed both front and rear, and in such prior devices apparatus is used to interconnect the garment panel portions to simplify the placing of the garment upon a patient. Examples of such garments are shown in U.S. Pat. Nos. 2,520,026; 4,258,440; and 4,651,353.

However, prior art garments having lateral access through releasable seams and edges have not been practical, and have not found popularity for hospital use. Such prior art garments are expensive, require large inventories to accommodate various sizes of patients, and may not be readily cleaned and maintained.

SUMMARY OF THE INVENTION

It is an object of the invention to provide an orthopedic pant garment which is of a low cost construction, provides excellent access to the leg or hip, or legs, being treated, and preserves the patient's modesty and dignity.

A further object of the invention is to provide an orthopedic pant garment which may be easily accommodated to even bedridden patients, and permits the patients, or nurses, to readily attach the garment to the wearer.

An additional object of the invention is to provide an orthopedic pant garment having both a long and a short leg, and yet inventorying is simplified as the front and rear panels of the garment are identical permitting the same garment to be used with patients having either right or left leg operations.

Yet a further object of the invention is to provide an orthopedic pant garment having substantially identical front and rear panel portions, and does not utilize a fly or crotch opening, and yet the garment does not significantly interfere with toilet functions.

An additional object of the invention is to provide an orthopedic pant garment which permits partial access to the leg or hip being treated, and also permits the pant leg to be closed while accommodating drainage tubes and medical apparatus attached to the wearer's leg.

In the practice of the invention a pant garment is formed of first and second panel portions which are, substantially, mirror images of each other. In the preferred embodiment, one of the leg portions of the pant garment is shorter than the other, but the configuration, cut and fullness of both panel portions are substantially identical whereby the garment may be worn to accommodate either right or left leg medical situations.

The lateral edges of at least one of the leg portions is interconnected by fasteners, preferably of the hook and loop type. The fasteners are spaced relative to each other so as to permit drainage tubes and the like to be located between adjacent fasteners.

The upper edge of the pant garment is provided with a belt loop waistband receiving a drawstring, and the lower edge of the leg portion utilizing the fasteners is preferably provided with a knitted ribbing for wear and fit purposes. The waistband may slide along the drawstring when tied about the patient's waist, and when the fasteners at a common leg portion are released one or both of the adjacent leg portions may slip along the drawstring for toilet access purposes.

The outer edge of one of the panel portions includes an inner surface to which one of the fastener elements are directly attached, as by sewing. The opposite outer edge of the opposed panel portion is preferably folded wherein the other fastener element may be sewn to the folded edge in opposed relationship to the associated fastener element thereby providing an attractive and wear resisting interconnection between the closed outer edges of the pant garment.

In an embodiment of the invention, both of the leg portions are of identical length, and each outer edge is provided with fasteners.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENTS

Figure 1:
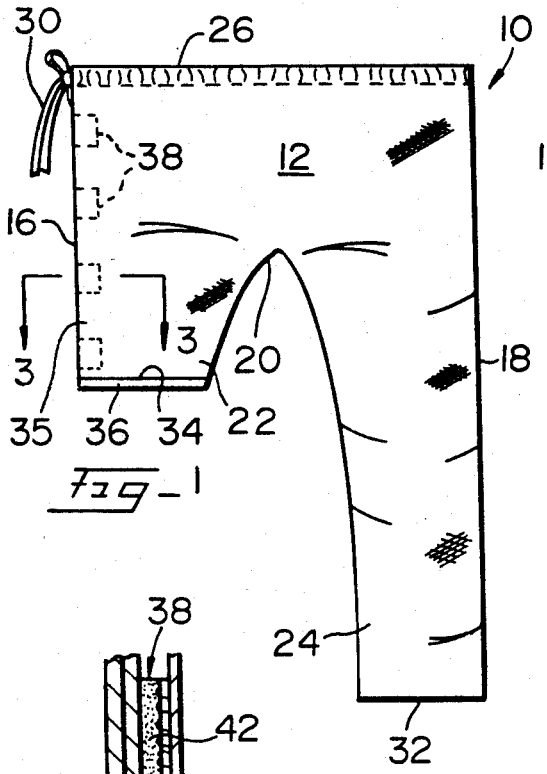
FIG. 1, is an elevational view of an orthopedic pant garment in accord with the invention, the releasable leg portion outer edge being closed.
Figure 4:
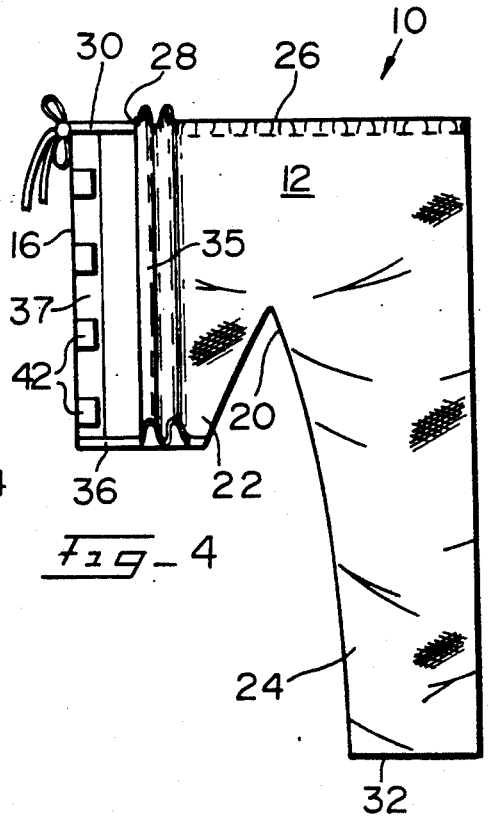
FIG. 4 is an elevational view of a pant garment in accord with the invention, illustrating the panel toward the viewer being unfastened at its left outer edge and slid along the drawstring to provide access to the wearer's leg, or preparatory for toilet purposes.

In the figures the orthopedic pant garment in accord with the invention is generally indicated by numeral 10. Basically, the garment, as viewed in FIGS. 1, 2 and 4, consists of a first panel portion 12 and a second panel portion 14. The panel portions 12 and 14 are substantially mirror images of each other, and are identical with respect to overall configuration, cut, fullness and other physical characteristics whereby the pant garment does not have a "front" and "back", except when worn. As viewed in FIG. 1, the garment left outer edge 16 of the garment is that edge which is capable of being opened and closed by fasteners, as later described, while, in the preferred embodiment, the garment right outer edge 18 is permanently closed either by sewing, or the panel portions 12 and 14 may consist of a single piece of fabric wherein the right outer edge 18 constitutes that portion of the single piece of fabric interconnecting the panel portions 12 and 14. The garment includes a crotch region 20, but no fly or opening is located adjacent the crotch region 20.

The garment includes a short leg portion 22, and a long leg portion 24. The upper edge of the garment is represented at 26 and is formed by a waistband belt loop 28 sewn into the garment for receiving the drawstring 30 therein. In this manner, the drawstring 30 is used to support the garment on the wearer, and yet the garment mounted upon the drawstring adjacent edge 16 may be slipped or pushed aside on the drawstring as will be described later with respect to FIG. 4.

The lower edge of the long leg portion 24 is represented at 32, and the short leg portion 22 includes a lower edge 34 to which knitted ribbing 36 is sewn. Preferably, the length of the short leg portion 22 is such that the ribbing 36 will be located in the knee region, or slightly above the knee.

Figure 2:
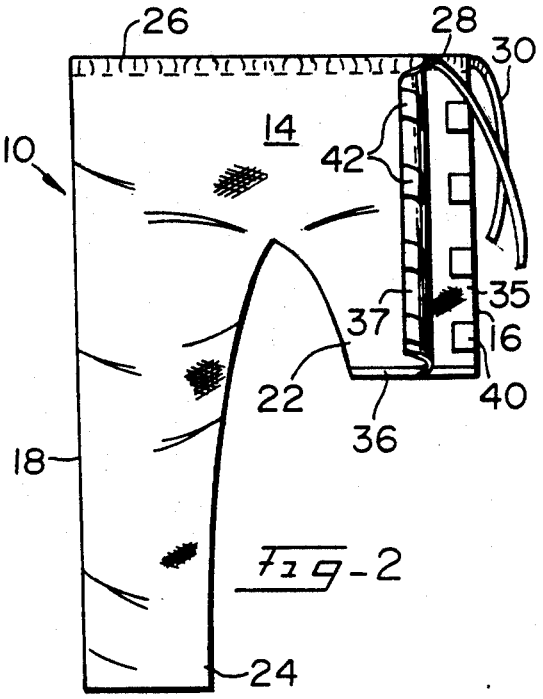
FIG. 2, is a side elevational view of the opposite side of the garment of FIG. 1, the drawstring being untied, and the panel portion toward the viewer being folded back to disclose the fastener elements.

The pant garment outer edge 16 is formed by an end region 35 defined on the panel portion 12, while the panel portion 14 includes an end region 37, FIG. 2, and fasteners 38 are mounted upon the end regions 35 and 37 to interconnect these end regions, or permit the edge 16 to be opened for access purposes.

Figure 3:
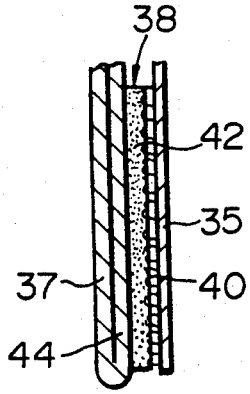
FIG. 3 is a plan, enlarged, detail sectional view through a fastener as taken along Section 3 - 3 of FIG. 1.

Preferably, the fasteners 38 consist of a hook element 40 which is sewn or otherwise attached to the end region 35, and a loop element 42 sewn to the end region 37 upon the inner surface of the fold 44 existing at the end region 37, FIG. 3. The fasteners 38 and elements 40 and 42 are of the type commonly available under the trademark VELCRO, and upon pressing the elements 40 and 42 together the elements adhere to each other, and yet may be disassembled by pulling apart.

As will be appreciated from the drawings, the fasteners 38 do not form a continuous fastening strip, but rather, adjacent fasteners 38 are spaced from each other. This spacing between fasteners permits the edge regions 35 and 37 to be interconnected by the fasteners, and yet drainage tubes or the like may pass through the edge of the garment between the fasteners permitting the patient's leg or hip to be treated and yet the garment is fully closed.

In use, assuming that only one of the patient's legs or hips has been operated upon, or requires treatment, the garment 10 is placed upon the patient such that the leg requiring attention will be located within the short leg portion 22. If the leg within portion 22 is the patient's right leg then panel portion 12 will constitute the "front" panel portion while panel portion 14 will constitute the "rear" panel portion. However, because the panel portions 12 and 14 are substantially identical and mirror images of each other a single garment 10 may be used to accommodate patients having either right or left legs which are to be placed within the short leg portion 22.

When placing the garment upon the patient, the edge 16 and panel end regions 35 and 37 may be "opened" by disengaging the elements 40 and 42, and the drawstring 30 may be placed about the patient's waist and tied. Thereupon, the elements 40 and 42 may be interconnected to encase the upper region of the patient's leg within leg portion 22.

When the physician desires to treat the leg or hip within leg portion 22, the fasteners 38 may be disconnected and the panel end portion 35 folded back, and the adjacent portion of the panel 12 may slide upon the drawstring 30 sufficiently to provide the desired access to the patient's leg. For toilet purposes, the panel end regions 35 and 37 may be disconnected and the panel portion 12 slid along the drawstring 30 sufficiently to achieve the desired purposes.

Figure 5:
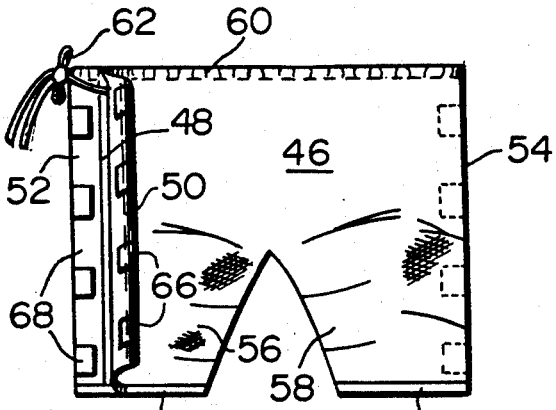
FIG. 5 is a front elevational view of an embodiment of an orthopedic pant garment in accord with the invention wherein both leg portions are short, and the outer edge of each leg portion is provided with fasteners, the left edge of the panel portion toward the viewer being folded back.

FIG. 5 illustrates an embodiment of the invention wherein the leg portions are of the same length, and the garment utilizes fasteners at each lateral side.

In the embodiment of FIG. 5, the first panel portion 46 is identical to the second panel portion 48 in configuration, cut and fitting. The panel portion 46 includes a left outer edge 50, and the panel portion 48 includes an outer edge 52, the outer edge 50 being shown in a folded back disconnected relationship to the edge 52. As viewed in FIG. 5, the right outer edge of the garment 54 is closed. The left leg portion as represented at 56, while a right leg portion is shown at 58. The upper edge of the garment includes the waistband belt loop 60 slidably encasing the drawstring 62, and at their lower edges the leg portions 56 and 58 each include a knitted ribbing 64.

Hook fastener elements 66 are sewn to the inner surface of the panel portion 46, while looped fastener elements 68 are sewn to the folded edges of the panel portion 48, and the elements 66 and 68 are connected and disconnected in the aforedescribed manner.

The garment of FIG. 5 may be used in those situations where both legs or hips require medical attention, and the advantages and operation of the garment of FIG. 5 will be similar to that of the garment of FIGS. 1–4 as previously described.

As will be appreciated from the above description, and drawings, an orthopedic pant garment constructed in accord with the disclosed embodiments is capable of preserving the patient's dignity and modesty, and yet permits full access to the wearer's leg or hip for inspection or treatment. The spacing between the fasteners permits drainage tubes and other medical apparatus to enter the garment, while keeping the garment lateral edges closed. The fact that both of the panels forming the garments are substantially identical permits the garment to be "reversible", reducing inventory requirements, and a garment constructed in accord with the invention may be readily washed and sterilized.

It is appreciated that various modifications to the inventive concepts may be apparent to those skilled in the art without departing from the spirit and scope of the invention.

I claim:

1. An orthopedic pant garment characterized by its ease of access to the wearer's leg and hip and modesty of wear comprising, in combination, a first panel portion, a second panel portion, said panel portions being the mirror image of each other and the general configuration, cut and fullness of said panel portions being identical so that either of said panel portions may constitute a front or a rear of the garment with respect to a wearer, an outer edge defined upon each of said panel portions, first and second leg portions defined on each of said panel portions, said outer edges defining outer edges of said leg portions, an upper edge defined on each of said panel portions, a belt loop defined in said panel portions upper edges, a drawstring located within said belt loop whereby said panel portions are slidably mounted on said drawstring, a lower edge defined upon each of said leg portions, and releasable hook and loop fasteners spaced from each other located along at least one of said panel portions outer edges releasably interconnecting the adjacent outer edges of aligned leg portions so that said fasteners may be released to provide full access to the wearer's leg and limited leg access is available intermediate adjacent fasteners, the vertical distance between said panel portions upper and lower edges at said leg portions differing to define a full leg portion and a short leg portion, said fasteners being located at the outer edge of said short leg portion.

2. In an orthopedic pant garment as in claim 1, said fasteners each including a first element and a second element, hooks defined on one of said elements and loops defined on the other element, said panel outer edge of said short leg portion first panel having an inner surface, one of said fastener elements being affixed to said inner surface of said first panel, said panel outer edge of said short leg portion second panel being defined by a folded over portion defining a fold inner surface, said other fastener element being attached to said fold inner surface.

3. In an orthopedic pant garment as in claim 2, a knit ribbing attached to said short leg portion lower edge.

* * * * *